US011760941B2

(12) United States Patent
Alshareef et al.

(10) Patent No.: US 11,760,941 B2
(45) Date of Patent: Sep. 19, 2023

(54) CATALYTIC PRE-REFORMING PROCESS TO CONVERT PARAFFINIC HYDROCARBONS

(71) Applicant: SAUDI ARABIAN OIL COMPANY, Dhahran (SA)

(72) Inventors: Ali H. Alshareef, Dhahran (SA); Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/149,000

(22) Filed: Jan. 14, 2021

(65) Prior Publication Data

US 2022/0220395 A1 Jul. 14, 2022

(51) Int. Cl.
*C10G 35/00* (2006.01)
*C10G 35/06* (2006.01)

(52) U.S. Cl.
CPC ... *C10G 35/065* (2013.01); *C10G 2300/1044* (2013.01); *C10G 2400/30* (2013.01)

(58) Field of Classification Search
CPC ..... C10G 35/04; C10G 35/06; C10G 35/065; C10G 35/085; C10G 59/00; C10G 59/02; C10G 59/06; C10G 61/04
See application file for complete search history.

(56) References Cited

U.S. PATENT DOCUMENTS 3,540,996 A * 11/1970 Zanolini ..... C10G 59/02 208/65
3,669,875 A 6/1972 Plank et al.
3,753,891 A * 8/1973 Graven ..... C10L 1/06 208/65
4,443,326 A 4/1984 Field
4,764,267 A 8/1988 Chen et al.
5,037,529 A 8/1991 Dessau et al.
6,299,994 B1 10/2001 Towler et al.
8,366,909 B2 2/2013 Miller
8,747,806 B2 6/2014 Catchpole
9,221,036 B2 12/2015 Koseoglu et al.
9,409,773 B2 8/2016 Achilles et al.
9,643,843 B2 5/2017 Morganroth et al.
10,081,009 B2 9/2018 Koseoglu et al.
10,293,332 B2 5/2019 Koseoglu et al.
10,787,618 B2 9/2020 Koseoglu et al.
2012/0024754 A1 2/2012 Chen et al.
2016/0145507 A1 5/2016 Miller
(Continued)

OTHER PUBLICATIONS

M. A. Rakib, et al., "Kinetic Simulation of a Compact Reactor System for Hydrogen Production by Steam Reforming of Higher Hydrocarbons," Canadian Journal of Chemical Engineering, 86:403-412 (Jun. 2008).

(Continued)

*Primary Examiner* — Prem C Singh
*Assistant Examiner* — Brandi M Doyle
(74) *Attorney, Agent, or Firm* — Leason Ellis LLP

(57) ABSTRACT

Improved catalytic reforming processes and systems employ reforming reactors in a more efficient manner and can avoid problems associated with yield loss. A portion of the naphtha feed is pre-reformed for conversion of paraffinic naphtha-range compounds into naphthenes and/or aromatics prior to passing to a reforming unit.

19 Claims, 3 Drawing Sheets

(56) References Cited

U.S. PATENT DOCUMENTS

| | | | | |
|---|---|---|---|---|
| 2019/0224653 | A1* | 7/2019 | Koseoglu | B01J 29/084 |
| 2019/0241486 | A1* | 8/2019 | Koseoglu | C07C 4/24 |

OTHER PUBLICATIONS

Q. Liu, et al., "Effect of the pre-reforming by Fe/bio-char catalyst on a twostage catalytic steam reforming of bio-oil," Fuel, 239:282-289 (Mar. 1, 2019) (Abstract Only).

Ancheyta-Juárez et al. "Kinetic Modeling of Naphtha Catalytic Reforming Reactions." Energy & Fuels 14.5 (2000): 1032-1037.

Meerbott et al. "Naphtha Processing over Platforming Catalyst—Effect of Sulfur on Catalyst Life." Industrial & Engineering Chemistry 49.4 (1957): 650-655.

Leprince. "Chapter 4.3.2: Reaction Thermodynamics." Petroleum Refining vol. 3: Conversion Processes. Editions Technip. Paris, France. 2001. 113-117.

* cited by examiner

CATALYTIC PRE-REFORMING PROCESS TO CONVERT PARAFFINIC HYDROCARBONS

RELATED APPLICATIONS

Not applicable.

BACKGROUND OF THE INVENTION

Field of the Invention

The present invention relates to conversion of gasoline-range hydrocarbons, and more particular to improved processes integrating catalytic reforming of gasoline-range hydrocarbons.

Description of Related Art

Catalytic reforming of hydrocarbon feedstocks in the naphtha/gasoline range is a major conversion process in petroleum refinery and petrochemical industries. Catalytic reforming is practiced in nearly every significant petroleum refinery in the world to produce aromatic intermediates for the petrochemical industry or gasoline components with high resistance to engine knock. Naphtha feeds to catalytic reforming include heavy straight run naphtha. Low octane naphtha is converted into high-octane motor gasoline blending stock and aromatics rich in benzene, toluene, and xylene with hydrogen and liquefied petroleum gas as a byproduct. With the fast growing demand in aromatics and demand of high-octane number motor gasoline blending stock, catalytic reforming is likely to remain one of the most important unit processes in the petroleum and petrochemical industry.

In catalytic reforming, a naphtha stream is typically first hydrotreated in a hydrotreating unit to produce a hydrotreated naphtha stream. The hydrotreating unit operates according to certain conditions, including temperature, pressure, hydrogen partial pressure, liquid hourly space velocity (LHSV), and catalyst selection and loading, which are effective to remove at least enough sulfur and nitrogen to meet requisite product specifications. For instance, hydrotreating in conventional naphtha reforming systems generally occurs under relatively mild conditions that are effective to remove sulfur and nitrogen to less than 0.5 ppmw levels.

There are several types of catalytic reforming process configurations, which typically differ in the manner in which they regenerate the reforming catalyst to remove the coke formed in the reactors. Commercially available catalytic reforming processes including: Rheniforming® (Chevron), Powerforming (Exxonmobil), CCR Platforming (UOP) and Octanizing (IFP/Axen). Catalyst regeneration, which involves combusting detrimental coke in the presence of oxygen, includes a semi-regenerative process, cyclic regeneration, and continuous catalyst regeneration (CCR). Semi-regeneration is the simplest configuration, and the entire unit, including all reactors in the series, is shut-down for catalyst regeneration in all reactors. The time between two regenerations is called a cycle. The catalyst retains its usefulness over multiple regeneration cycles. Cyclic configurations utilize an additional "swing" reactor to permit one reactor at a time to be taken off-line for regeneration while the others remain in service. Cyclic reformers run under more severe operating conditions for improved octane number and yields. Individual reactors are taken offline by a special valving and manifold system and regenerated while the other reformer unit continues to operate. Continuous catalyst regeneration configurations, which are the most complex, provide for essentially uninterrupted operation by catalyst removal, regeneration and replacement. In these reformers, the catalyst is in a moving bed and regenerated frequently. This allows operation at much lower pressure with a resulting higher product octane, C5+, and hydrogen yield. These types of reformers are radial flow and are either separated as in regenerative unit or stacked one above the other. While continuous catalyst regeneration configurations include the ability to increase the severity of the operating conditions, due to higher catalyst activity, the associated capital investment is necessarily higher.

The hydrotreated naphtha stream is typically reformed in a reforming unit such as any of those described above to produce a gasoline reformate product stream. The reformate is sent to the gasoline pool, or to aromatics extraction complex before sending the raffinate to the gasoline pool, to be blended with other gasoline components to meet the required specifications. Some gasoline blending pools include $C_4$ and heavier hydrocarbons having boiling points of less than about 205° C. Catalytic reforming is typically used for treatment of feedstocks rich in paraffinic and naphthenic hydrocarbons. In catalytic reforming, diverse reactions occur, including dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. A particular hydrocarbon/naphtha feed molecule may undergo more than one category of reaction and/or may form more than one product. Basically, the process re-arranges or re-structures the hydrocarbon molecules in the naphtha feedstocks as well as breaking some of the molecules into smaller molecules. Catalytic reforming converts low octane normal paraffins to isoparaffins and naphthenes. Naphthenes are converted to higher octane aromatics. The aromatics are left essentially unchanged, or some may be hydrogenated to form naphthenes due to reverse reactions taking place in the presence of hydrogen.

The reformate from a catalytic reforming unit is usually sent to an aromatics recovery complex where it undergoes several processing steps in order to recover high value products such as xylenes and benzene, and to convert lower value products such as toluene into higher value products. For example, the aromatics present in the reformate are usually separated into different fractions by carbon number, such as benzene, toluene, xylenes, and ethylbenzene, etc. The C8 fraction is then commonly subjected to a processing scheme to make more high value para-xylene. Para-xylene is usually recovered in high purity from the C8 fraction by separating the para-xylene from the ortho-xylene, meta-xylene, and ethylbenzene using selective adsorption or crystallization. The ortho-xylene and meta-xylene remaining from the para-xylene separation are isomerized to produce an equilibrium mixture of xylenes. The ethylbenzene is isomerized into xylenes or is dealkylated to benzene and ethane. The para-xylene is then separated from the ortho-xylene and the meta-xylene using adsorption or crystallization and the para-xylene-depleted-stream is recycled to extinction to the isomerization unit and then to the para-xylene recovery unit until all of the ortho-xylene and meta-xylene are converted to para-xylene and recovered.

Paraffinic components typically do not readily convert during reforming reactions. A portion of the paraffinic components undergo isomerization reactions, dehydrogenation reactions, or dehydrocyclization reactions with and subsequent aromatization reactions. However, undesired reactions of such paraffins include cracking into light ends, which result in yield loss. Further, it is undesirable for such paraffins to pass through a reforming unit without significant conversion.

While existing catalytic reforming processes are suitable for their intended purposes, a need remains in the art for efficiency improvements without loss of contribution to the gasoline pool, or an equivalent contribution to other petrochemical feedstock pools.

SUMMARY

In certain embodiments of the present disclosure, a light naphtha feed that is rich in paraffins is reacted in a pre-reforming reactor (which can be a separate unit or part of a modified catalytic reforming unit). The pre-reforming reactor contains an effective amount of a dehydrocyclization catalyst including a zeolitic-based component and/or other components suitable for dehydrocyclization. The effluent from the pre-reforming reactor, referred to as a pre-reformed stream, contains a reduced paraffinic content due to the dehydrocyclization reactions, and contains an increased naphthenic content and/or aromatic content. The pre-reformed stream is subjected to catalytic reforming (in a separate catalytic reforming unit or a catalytic reforming reactor of a modified catalytic reforming unit). Heavy naphtha can also be subjected to catalytic reforming, together with the pre-reformed stream or separately.

In certain embodiments of the present disclosure, a paraffinic feed such as a paraffinic naphtha feed is reacted in a pre-reforming reactor (which can be a separate unit or part of a modified catalytic reforming unit). The paraffinic feed is obtained, for example, by aromatic extraction of a naphtha feed or a heavy naphtha feed, whereby an aromatic-rich portion bypasses catalytic reforming and is passed to an aromatic complex, and an aromatic-lean portion is passed to the pre-reforming reactor. In certain embodiments a light naphtha feed is also passed to the pre-reforming reactor. The pre-reforming reactor contains an effective amount of a dehydrocyclization catalyst including a zeolitic-based component and/or other components suitable for dehydrocyclization. The effluent from the pre-reforming reactor, the pre-reformed stream, contains a reduced paraffinic content, and contains an increased naphthenic content and/or aromatic content. The pre-reformed stream is subjected to catalytic reforming (in a separate catalytic reforming unit or a catalytic reforming reactor of a modified catalytic reforming unit).

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The invention will be described in further detail below and with reference to the attached drawings in which the same or similar elements are referred to by the same number, and where.

DETAILED DESCRIPTION

Figure 1:
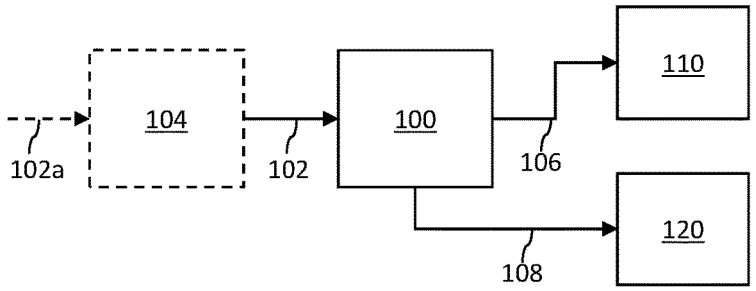
FIG. 1 (Prior Art)
FIG. 1 is a process flow diagram of a conventional catalytic reforming process and system.

As used herein, the term "stream" (and variations of this term, such as hydrocarbon stream, feed stream, product stream, and the like) may include one or more of various hydrocarbon compounds, such as straight chain, branched or cyclical alkanes, alkenes, alkadienes, alkynes, alkylaromatics, alkenyl aromatics, condensed and non-condensed di-, tri- and tetra-aromatics, and gases such as hydrogen and methane, C2+ hydrocarbons and further may include various impurities.

The term "zone" or "unit" refers to an area including one or more equipment, or one or more sub-zones. Equipment may include one or more reactors or reactor vessels, heaters, heat exchangers, pipes, pumps, compressors, and controllers. Additionally, an equipment, such as reactor, dryer, or vessels, further may include one or more zones.

Volume percent or "V %" refers to a relative value at conditions of 1 atmosphere pressure and 15° C.

The phrase "a major portion" with respect to a particular stream or plural streams, or content within a particular stream, means at least about 50 wt % and up to 100 wt %, or the same values of another specified unit.

The phrase "a significant portion" with respect to a particular stream or plural streams, or content within a particular stream, means at least about 75 wt % and up to 100 wt %, or the same values of another specified unit.

The phrase "a substantial portion" with respect to a particular stream or plural streams, or content within a particular stream, means at least about 90, 95, 98 or 99 wt % and up to 100 wt %, or the same values of another specified unit.

The phrase "a minor portion" with respect to a particular stream or plural streams, or content within a particular stream, means from about 1, 2, 4 or 10 wt %, up to about 20, 30, 40 or 50 wt %, or the same values of another specified unit.

The term "rich" means that at least a major portion, a significant portion or a substantial portion of a stream is composed of a specified compound or class of compounds, as a mole percentage or a weight percentage.

The term "lean" means that no more than a minor portion of a stream is composed of a compound or class of compounds, as a mole percentage or a weight percentage.

The modifying term "straight run" is used herein having its well-known meaning, that is, describing fractions derived directly from the atmospheric distillation unit, optionally subjected to steam stripping, without other refinery treatment such as hydroprocessing, fluid catalytic cracking or steam cracking. An example of this is "straight run naphtha" and its acronym "SRN" which accordingly refers to "naphtha" defined herein that is derived directly from the atmospheric distillation unit, optionally subjected to steam stripping, as is well known.

The term "naphtha" as used herein refers to hydrocarbons boiling in the range of about 20-220, 20-210, 20-200, 20-190, 20-180, 20-170, 30-220, 30-210, 30-200, 30-190, 30-180, 30-170, 32-220, 32-210, 32-200, 32-190, 32-180, 32-170, 36-220, 36-210, 36-200, 36-190, 36-180 or 36-170° C.

The term "light naphtha" as used herein refers to hydrocarbons boiling in the range of about 20-110, 20-100, 20-90, 20-88, 20-80, 30-110, 30-100, 30-90, 30-88, 30-80, 32-110, 32-100, 32-90, 32-88, 32-80, 36-110, 36-100, 36-90, 36-88 or 36-80° C. In certain embodiments, light naphtha refers to a stream that is substantially composed of C5-C6 or C5-C7 hydrocarbons.

The term "heavy naphtha" as used herein refers to hydrocarbons boiling in the range of about 80-220, 80-210, 80-200, 80-180, 80-180, 80-170, 88-220, 88-210, 88-200, 88-188, 88-180, 88-170, 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180 or 110-170° C. In certain embodiments, heavy naphtha refers to a stream that is substantially composed of C7-C11 or C7-C12 hydrocarbons.

The terms "reformate" as used herein refer to a mixture of hydrocarbons that are rich in aromatics, and are intermediate products and/or blending components in the production of chemicals and/or gasoline, and include hydrocarbons boiling in the range of about 30-220, 30-210, 30-200, 30-190, 30-180, 30-170, 32-220, 32-210, 32-200, 32-190, 32-180, 32-170, 36-220, 36-210, 36-200, 36-190, 36-180 or 36-170° C.

The term "light reformate" as used herein refers to reformates boiling in the range of about 30-120, 30-110, 30-100, 30-90, 30-88, 30-80, 32-120, 32-110, 32-100, 32-90, 32-88, 32-80, 36-120, 36-110, 36-100, 36-90, 36-88 or 36-80° C. In certain embodiments, light reformate refers to a reformate stream that is substantially composed of C5-C6 or C5-C7 hydrocarbons.

The term "heavy reformate" as used herein refers to reformates boiling in the range of about 80-220, 80-210, 80-200, 80-180, 80-180, 80-170, 88-220, 88-210, 88-200, 88-188, 88-180, 88-170, 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180, 110-170, 120-220, 120-210, 120-200, 120-190, 120-180 or 120-170° C. In certain embodiments, heavy reformate refers to a reformate stream that is substantially composed of C7-C11 or C7-C12 hydrocarbons.

The term "aromatic products" includes C6-C8 aromatics, such as benzene, toluene, mixed xylenes (commonly referred to as BTX), or benzene, toluene, ethylbenzene and mixed xylenes (commonly referred to as BTEX), and any combination thereof.

An embodiment of conventional gasoline reforming process is shown and described with reference to FIG. 1. A naphtha feed 102 that contains aromatics, normal paraffins, isoparaffins and naphthenes is routed to a reforming unit 100. The source of naphtha can be, for example, a distillation column where the initial source is crude oil (straight run naphtha), hydrotreated straight run naphtha, another naphtha hydrotreater, wild naphtha from a hydrocracking process, or hydrotreated coker naphtha.

As shown in dashed lines, a hydrotreating unit 104 can be integrated, receiving a naphtha feed 102*a* and producing a hydrotreated naphtha feed 102. The hydrotreating unit operates as is known, for instance according to certain conditions, including temperature, pressure, hydrogen partial pressure, liquid hourly space velocity (LHSV), hydrogen to oil ratio, and catalyst selection and loading, which are effective to remove at least enough sulfur and nitrogen to meet requisite product specifications. For instance, hydrotreating in conventional naphtha reforming systems generally occurs under relatively mild conditions that are effective to remove sulfur and nitrogen to less than 0.5 ppmw levels. Hydrotreated effluent can also be passed through one or more a separation zone to remove light gases, such as hydrogen and C1-C4 gases that be recovered and used elsewhere, for instance, for hydrogen recycle (not shown) within the hydrotreating unit. In typical pre-reforming naphtha hydrotreaters, hydrogen produced in the catalytic reformer is used to meet all or a portion of the hydrotreating hydrogen requirements.

Reactions taking place in the catalytic reforming unit 100 include dehydrogenation of naphthenes to aromatics, isomerization of n-paraffins to iso-paraffins, dehydrocyclization of paraffins to aromatics, all of which are desirable; and hydrocracking of paraffins to lower molecular weight compounds, which are not desirable.

Dehydrogenation and dehydrocyclization reactions are highly endothermic and result in a decrease in reaction temperature. The products include reformate, which can be utilized as full range reformate (not shown in FIG. 1) and divided as a first reformate stream 106 and a second reformate stream 108. Reformate can also be passed through one or more a separation zone to remove light gases, such as hydrogen and C1-C4 gases that be recovered and used elsewhere, for instance, for hydrogen recycle (not shown) within the reformer or elsewhere, for instance the hydrotreater, when an excess of hydrogen is produced. In certain embodiments a separation unit such as a flash or distillation unit (not shown) is used to separate the reformate into a light reformate stream 106 and a heavy reformate stream 108.

In certain embodiments, the light reformate stream 106 is routed to a gasoline component blending pool, or gasoline pool, shown as zone 110; and the heavy reformate stream 108 is passed to an aromatic complex 120 (also known as an aromatics recovery complex) for recovery of aromatic products (not shown).

In general, the operating conditions for a reforming unit include a temperature in the range of from about 400-600, 400-560, 430-600, 430-560, 450-600 or 450-560° C.; a pressure in the range of from about 1-50, 1-20, 1-10, 4-50, 4-20 or 4-10 bars; and a liquid hourly space velocity in the range of from about 0.5-40, 0.5-10, 0.5-4, or 0.5-2 $h^{-1}$. Cyclic and CCR process designs include online catalyst regeneration or replacement, and accordingly the lower pressure ranges as indicated above are suitable. For instance, CCRs can operate in the range of about 5 bars, while semi regenerative systems operate at the higher end of the above ranges, with cyclic designs typically operating at a pressure higher than CCRs and lower than semi regenerative systems.

An effective quantity of reforming catalyst is provided. Such catalysts include mono-functional or bi-functional reforming catalysts, which generally contain one or more active metal component of metals or metal compounds (oxides or sulfides) selected from the Periodic Table of the Elements IUPAC Groups 8-10. A bi-functional catalyst has both metal sites and acidic sites. In certain embodiments, the active metal component can include one or more of Pt, Re, Au, Pd, Ge, Ni, Ag, Sn, Ir or halides. The active metal component is typically deposited or otherwise incorporated on a support, such as amorphous alumina, amorphous silica alumina, zeolites, or combinations thereof. In certain embodiments, effective reforming catalysts including IUPAC Group 8 metals of the Periodic Table, including precious metals such as Pt or Pt-alloy active metal components, which are supported on alumina, silica or silica-alumina. In certain operations, for instance where silica-alumina based catalysts are used for reforming, acidity is maintained by chlorination. The hydrocarbon/naphtha feed composition, the impurities present therein, and the desired products will determine such process parameters as choice of catalyst(s), process type, and the like. Types of chemical reactions can be targeted by a selection of catalyst or operating conditions known to those of ordinary skill in the art to influence both the yield and selectivity of conversion of paraffinic and naphthenic hydrocarbon precursors to particular aromatic hydrocarbon structures.

As mentioned above, there are several types of catalytic reforming process configurations that carry out the reforming reactions, and differ mainly regarding regeneration of the reforming catalyst to remove coke formed during reaction. Catalyst regeneration involves combusting coke formed on catalyst particles in the presence of oxygen, and reactors are known that operate as a semi-regenerative process, a cyclic regeneration process, and a continuous regeneration process, as described above.

The hydrocarbon/naphtha feed composition, the impurities present therein, and the desired products determine process parameters including selection of catalyst(s), process type and the like. Types of chemical reactions can be targeted by a selection of catalyst and/or operating conditions to influence both the yield and selectivity of conversion of paraffinic and naphthenic hydrocarbon precursors to particular aromatic hydrocarbon structures.

Figure 2:
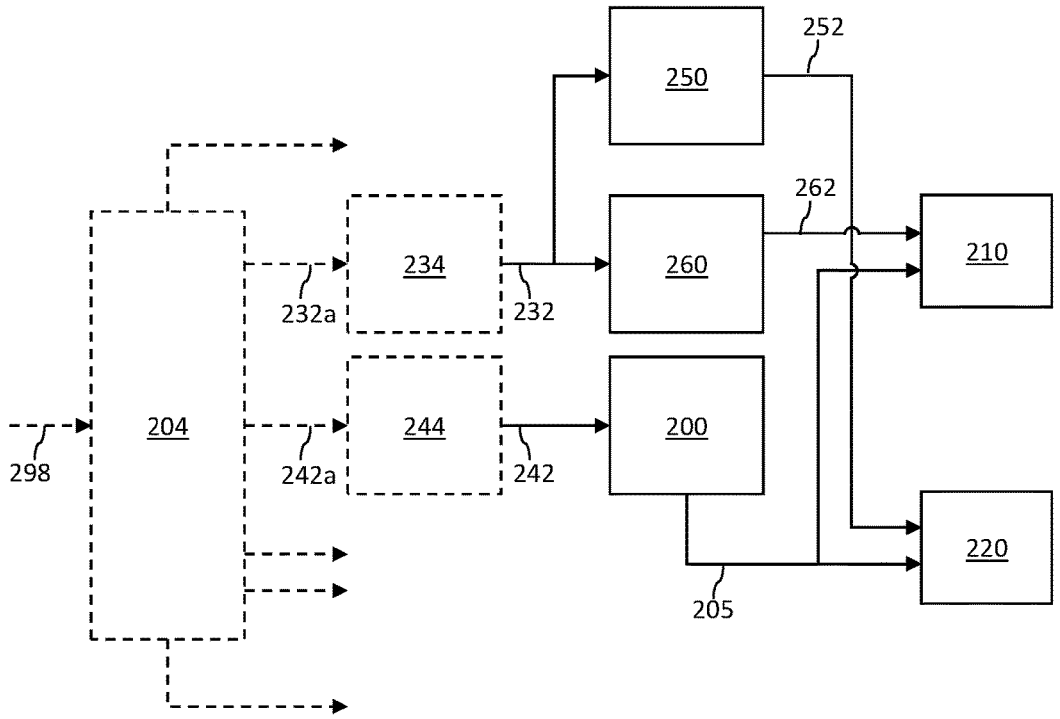
FIG. 2 (Prior Art)
FIG. 2 is a process flow diagram of a conventional process and system for treatment of naphtha to produce aromatics and gasoline.

With reference to FIG. 2, an embodiment of conventional process for treating naphtha is shown. The depiction in FIG. 2 includes a light naphtha feed 232 and a heavy naphtha feed 242. The units include: for treatment of the heavy naphtha feed 242, that contains aromatics, normal paraffins, isoparaffins and naphthenes, and includes for example C6-C12 hydrocarbons, a catalytic reforming unit 200; for treatment of the light naphtha feed 232 that contains paraffins, isoparaffins and naphthenes, and includes for example C5-C6 hydrocarbons, a steam cracking unit 250 and/or an isomerization unit 260. In general, the operating conditions, type of reactor, and reforming catalyst of the reforming unit 200 are as above in the embodiment described in conjunction with FIG. 1.

As with the arrangement described above in conjunction with FIG. 1, the system also includes a gasoline pool and an aromatic complex, shown in FIG. 2 as a gasoline pool zone 210 and an aromatic complex 220 for recovery of aromatic products (not shown).

As shown in dashed lines, the light naphtha feed 232 and the heavy naphtha feed 242 can be derived from one or more hydrotreating units, for instance as described above in conjunction with FIG. 1. In certain embodiments, a common hydrotreating unit 104 is used as in FIG. 1 for a full range naphtha steam, and the light naphtha feed 232 and the heavy naphtha feed 242 are separated from the hydrotreated naphtha. In other embodiments as shown in FIG. 2, separate hydrotreating units are used including one for a light naphtha feed 232*a* and a heavy naphtha feed 242*a*, depicted as a light hydrotreating unit 234 producing hydrotreated light naphtha 232, and a heavy hydrotreating unit 244 producing hydrotreated heavy naphtha 242. In further embodiments (not shown) hydrotreated light naphtha portion of the effluents from the heavy hydrotreating unit 244 are combined with hydrotreated light naphtha 232 (not shown). The hydrotreating unit(s) can operate as is known, for instance as described in conjunction with FIG. 1.

The source of naphtha can be, for example, a distillation column where the initial source is crude oil (straight run naphtha), hydrotreated straight run naphtha, another naphtha hydrotreater, wild naphtha from a hydrocracking process, hydrotreated coker naphtha, or a mixture of these sources. As depicted in dashed lines FIG. 2, naphtha can be from a distillation column 204 where the initial hydrocarbon feed 298, such as crude oil or a naphtha-containing fraction thereof, is subjected to distillation or separation to produce light naphtha 232*a* and heavy naphtha 242*a*. Other products that may be derived from the distillation column 204 are not delineated, but can include C1-C4 hydrocarbons, and hydrocarbon product boiling above the naphtha range including for instance diesel, gas oil and residue.

The heavy naphtha 242 (which has been hydrotreated or otherwise contains sufficiently low sulfur and nitrogen content for reforming) is passed to the catalytic reforming unit 200 for reforming as is known, that is, dehydrogenation of naphthenes to aromatics, isomerization of n-paraffins to iso-paraffins, dehydrocyclization of paraffins to aromatics, all of which are desirable; and hydrocracking of paraffins to lower molecular weight compounds, which are not desirable. The products include a reformate stream 205. In certain embodiments a separation unit such as a flash or distillation unit (not shown) is used to separate the reformate stream 205 into a light reformate a heavy reformate stream, as described with respect to FIG. 1, or otherwise utilized. For example, all or a portion of a light reformate can be passed to the gasoline pool 210, and all or a portion a heavy reformate can be passed to the aromatic complex 220. In other embodiments, the full range of the reformate stream 205 is separated by a diverter, so that all or a portion of can be passed to the gasoline pool 210, all or a portion can be passed to the aromatic complex 220, or the reformate stream 205 can be divided between the gasoline pool 210 and the aromatic complex 220. For instance, the routing selection or proportion can be based on products that are targeted in the refinery. In additional embodiments, the full range reformate stream 205 is passed to the aromatic complex 220 and aromatic-lean raffinate is passed to the gasoline pool 210.

The light naphtha 232 (which has been hydrotreated or otherwise contains sufficiently low sulfur and nitrogen content for steam cracking and/or isomerization) is passed to the steam cracking unit 250 and/or the isomerization unit 260 for treatment of the paraffin-rich stream. All or a portion of the effluents from the steam cracking unit 250, shown as stream 252, are passed to the aromatic complex 220. In some embodiments (not shown) a portion of steam cracking effluents, for instance pyrolysis gasoline, is passed to the gasoline pool 210 directly, and the reminder products, such as light olefins, are passed to the aromatics complex 220. All or a portion of the isomerized paraffins from the isomerization unit 260, shown as stream 262, are passed to the gasoline pool 210.

Improved catalytic reforming processes and systems employ reforming reactors in a more efficient manner and can avoid problems associated with yield loss. A portion of the naphtha feed is pre-reformed for conversion of paraffinic naphtha-range compounds into naphthenes and/or aromatics prior to passing to a reforming unit. According to the systems and processes for naphtha treatment that are disclosed herein, including production of gasoline blending components and/or aromatic products, an operator can use existing or future developed catalytic reforming units in a more efficient manner, and minimize or eliminate problems associated with yield loss. Conventionally paraffins including isoparaffins are undesirably subjected to cracking in the reforming unit, resulting in yield loss. According to the presently disclosed systems and processes, paraffinic naphtha (light naphtha and/or an aromatic-lean fraction of a naphtha or heavy naphtha stream) is sent to a pre-reforming unit, or a separate reactor within a catalytic reforming unit, for conversion of paraffinic naphtha compounds into naphthenes and/or aromatics. The resulting effluent with a lower paraffinic content is then sent to a conventional reforming reactor or unit for dehydrogenation and other reforming reactions. The systems and process herein offer a new route for conversion of light naphtha into value added products, particularly to increase the production of gasoline blending components and/or aromatic products. Similarly, paraffins in heavy naphtha are less reactive, and last to convert in commercial reformers. In the process herein, a pre-reforming step in integrated to convert paraffins in the light naphtha feed into naphthenes. Thee converted stream included increased naphthenic content is passed to the catalytic reforming step within which naphthenes are converted to aromatics.

Naphthenic compounds are readily convertible and first components to reform. In the systems and process herein, prior to typical catalytic reforming reactions, a pre-reforming step is included (which can be a separate reaction unit, or a reactor or reaction zone within the catalytic reformer unit) in which paraffins are converted into naphthenic compounds prior to catalytic reforming. The pre-reforming step utilizes as a dehydrocyclization catalyst a zeolitic-based component and/or other components suitable for dehydrocyclization, to target paraffinic naphtha or hydrocarbons, such as light naphtha, or separated paraffins from heavy naphtha, through a pre-reforming process to convert the paraffins into naphthenic components. The pre-reforming reactions include dehydrocyclization to produce an effluent that is passed to a catalytic reforming unit or a reactor of a catalytic reforming unit, such as a CCR reforming unit or a or fixed-bed semi-regenerative reforming unit. Typically an undesirable amount of the paraffinic content of the reformer feed is not easily converted at reforming conditions, and at harsher conversion conditions will crack into light ends that result in yield loss. The paraffinic content of the reformer feed is subjected to dehydrocyclization reactions to form naphthenic components in the pre-reforming step, which are aromatized in the reforming step of a reforming unit. Accordingly, there is provided herein a process to convert a portion of heavy naphtha, light naphtha, or paraffinic naphtha in general, with an effective dehydrocyclization catalyst system and under effective reaction conditions to dehydrocylize the alkanes partially, through forming naphthenes only, and feeding this product into typical reforming units, resulting in formation of aromatics and lower yield loss.

Figure 3:
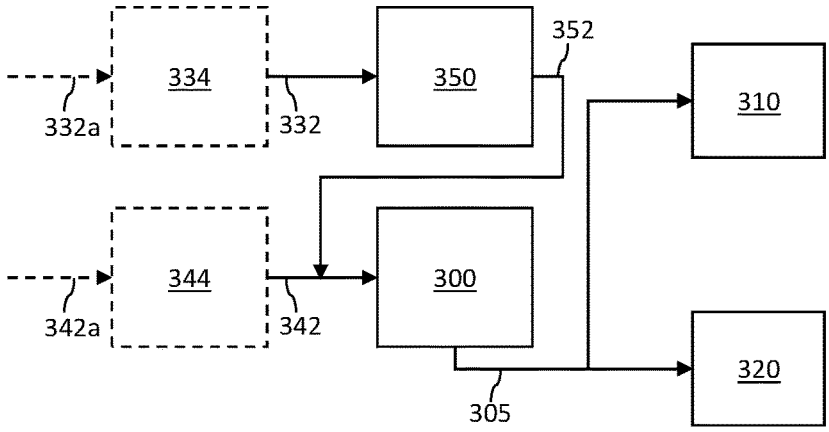
FIG. 3 is a process flow diagram of one embodiment of a process and system for treatment of naphtha to produce aromatics and gasoline.

With reference to FIG. 3, an embodiment of an integrated process and system for treatment of naphtha to produce aromatics and gasoline is schematically depicted. The depiction in FIG. 3 includes a light naphtha feed 332 and a heavy naphtha feed 342. In certain embodiments, as indicated in dashed lines, initial feeds 332*a*, 342*a* may require hydrotreating to reduce sulfur and/or nitrogen content of the feed(s). In the embodiment shown in FIG. 3, separate hydrotreating units are used including one for a light naphtha feed 332*a* and a heavy naphtha feed 342*a*, depicted as a light hydrotreating unit 334 producing hydrotreated light naphtha 332, and a heavy hydrotreating unit 344 producing hydrotreated heavy naphtha 342. In further embodiments (not shown) hydrotreated light naphtha portion of the effluents from the heavy hydrotreating unit 344 are combined with hydrotreated light naphtha 332 (not shown). Alternatively (not shown) the initial naphtha feed that requires hydrotreating is passed to a common hydrotreating unit, and hydrotreated light naphtha and hydrotreated heavy naphtha are treated as described with respect to streams 332 and 342. The hydrotreating unit(s) can operate as is known, for instance as described in conjunction with FIG. 1. Although the light naphtha feed 332 and the heavy naphtha feed 342 are depicted as obtained from hydrotreating units, any source of light naphtha and heavy naphtha can be used, along or in combination with hydrotreated light naphtha and hydrotreated heavy naphtha, such as from another naphtha hydrotreater, wild naphtha from a hydrocracking process, or hydrotreated coker naphtha.

The units of the integrated process and system for treatment of naphtha to produce aromatics and gasoline include: for treatment of the heavy naphtha feed 342 that contains aromatics, normal paraffins, isoparaffins and naphthenes and includes for example C7-C11 or C7-C12 hydrocarbons, and for treatment of a pre-reformed light naphtha stream 352, a catalytic reforming unit 300; for treatment of the light naphtha feed 332 that contains paraffins, iso-paraffins and naphthenes, and includes for example C5-C6 or C5-C7 hydrocarbons, a pre-reforming unit 350. In general, the operating conditions, type of reactor, and reforming catalyst of the reforming unit 300 can be as above in the embodiment described in conjunction with FIG. 1 that is effective for dehydrogenation and other reforming reactions. As with the arrangement described above in conjunction with FIG. 1, the system also includes a gasoline pool and an aromatic complex, shown in FIG. 3 as a gasoline pool zone 310 and an aromatic complex 320 for recovery of aromatic products (not shown).

In operation of the system depicted in FIG. 3, the C5-C6 or C5-C7 light naphtha feed 332 is passed to the pre-reforming unit 350 for dehydrocyclization and to thereby produce the pre-reformed light naphtha stream 352 that contains reduced paraffinic content, and contains an increased naphthenic content and/or aromatic content, relative to the light naphtha feed 332. The pre-reformed light naphtha stream 352 is passed to the catalytic reforming unit 300, along with the C7-C12 or C7-C11 heavy naphtha stream 342. Accordingly, the light naphtha stream 332 contains paraffins, iso-paraffins and naphthenes, and this light naphtha stream 332 is converted to increase the naphthenic content and provide the pre-reformed light naphtha stream 352 as additional feed to the catalytic reforming unit 300, which is less prone to cracking into less valuable light hydrocarbons as compared to the light naphtha stream 332, thereby increasing the yield and in certain embodiments the quality of the reformate stream 305. In certain embodiments, all or a portion of unconverted light naphtha contained in the effluent stream 352 can be recycled to the pre-reforming unit 350. For example, a separation unit such as a flash or distillation unit (not shown) is used to separate the effluent stream 352 converted products and unconverted light naphtha, such as C5-C6 components, which are recycled to the pre-reforming unit 350. In certain embodiments aromatics are removed from the effluent stream 352 with a suitable separation apparatus (not shown) such as an aromatic extraction unit, whereby separated aromatics can bypass the reformer and be passed to the aromatic complex 320.

The reformate stream 305 can be processed as full range reformate, or separated into a light reformate a heavy reformate stream, as described with respect to FIGS. 1 and 2, or otherwise utilized. In certain embodiments a separation unit such as a flash or distillation unit (not shown) is used to separate the reformate stream 305 into a light reformate a heavy reformate stream, as described with respect to FIG. 1, or otherwise utilized. For example, all or a portion of a light reformate can be passed to the gasoline pool 310, and all or a portion a heavy reformate can be passed to the aromatic complex 320. In other embodiments, the full range of the reformate stream 305 is separated by a diverter, so that all or a portion of can be passed to the gasoline pool 310, all or a portion can be passed to the aromatic complex 320, or the reformate stream 305 can be divided between the gasoline pool 310 and the aromatic complex 320. For instance, the routing selection or proportion can be based on products that are targeted in the refinery. In additional embodiments, the full range reformate stream 305 is passed to the aromatic complex 320 and aromatic-lean raffinate is passed to the gasoline pool 310.

An apparatus for the pre-reforming unit 350 in the present disclosure can be any suitable unit containing an effective quantity of pre-reforming dehydrocyclization catalyst effective to carry out the dehydrocyclization reactions. In the presence of the pre-reforming dehydrocyclization catalyst and under suitable operating conditions (including temperature, pressure, LHSV and hydrogen/hydrocarbon molar ratio), the paraffinic light naphtha stream 332 dehydrocyclizes and forms naphthenes. In certain embodiments a small percentage of the feedstock is converted to aromatics. For instance, the naphthenic content of the pre-reformed light naphtha stream 352 can be about 50-100% higher than that of the initial light naphtha stream 332. Further, some C1-C4 hydrocarbons are formed in the process, including methane, ethane, propane and butane, for instance about 1-10 W % of the total dehydrocyclization effluent.

Various types of apparatuses may be used. In accordance with some embodiments, the process of the present disclosure may be conducted in a fixed-bed reactor, an ebullated-bed reactor, a slurry-bed reactor, a moving-bed reactor, a continuous stirred tank reactor, a batch type reactor, and the like. The process is conducted at conditions suitable for effectuating the dehydrocyclization reactions of paraffinic naphtha. In some embodiments, the pre-reforming reactor is operated at: a reaction temperature range of about 400-600, 450-600, 470-600, 400-530, 450-530 or 470-530° C.; a pressure of about 1-20, 2-20, 1-6, 2-6, 1-4 or 2-4 bars; an LHSV, on a fresh feed basis relative to the dehydrocyclization catalysts, of about 1-5, 1-8 or 1-10 $h^{-1}$; and a hydrogen/hydrocarbon mole ratio of about 1-10, 3-10, 1-5 or 3-5.

Figure 4:
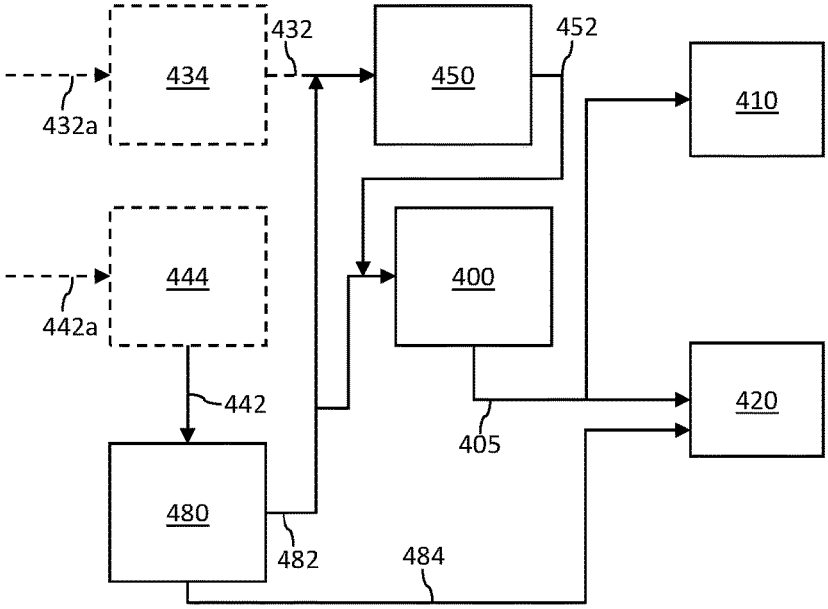
FIG. 4 is a process flow diagram of another embodiment of a process and system for treatment of naphtha to produce aromatics and gasoline.

With reference to FIG. 4, another embodiment of an integrated process and system for treatment of naphtha to produce aromatics and gasoline is schematically depicted. The depiction in FIG. 4 includes a naphtha feed 442, or a heavy naphtha feed 442 and optionally a light naphtha feed 432. The units include: for separation of the naphtha or heavy naphtha feed 442, a separation zone 480 such as an aromatics extraction unit; for treatment of a pre-reformed stream 452, and in certain embodiments all or a portion (that is, 0-100 wt %) of an aromatic-lean stream 482 from the separation zone 480 that contains as a significant or substantial portion thereof normal paraffins, isoparaffins and naphthenes, and includes for example C7-C12 hydrocarbons, a catalytic reforming unit 400; and for treatment of all or a portion (that is, 0-100 wt %) of an aromatic-lean stream 482 from the separation zone 480 that contains normal paraffins, isoparaffins and naphthenes, and the optional light naphtha feed 432 that contains paraffins, iso-paraffins and naphthenes and includes for example C5-C6 hydrocarbons, a pre-reforming unit 450. The operating conditions and type of reactor for the pre-reforming unit 450 can be similar or the same as those described above for the pre-reforming unit 350 in the system described with respect to FIG. 3. In general, the operating conditions, type of reactor, and reforming catalyst of the reforming unit 400 can be as above in the embodiments described in conjunction with FIGS. 1 and 2 that is effective for dehydrogenation and other reforming reactions. As with the arrangements described above in conjunction with FIGS. 1 and 2, the system also includes a gasoline pool and an aromatic complex, shown in FIG. 4 as a gasoline pool zone 410 and an aromatic complex 420 for recovery of aromatic products (not shown).

In operation of the system depicted in FIG. 4, the naphtha or heavy naphtha stream 442 is passed to the separation zone 480; a first stream 482 that is aromatic-lean (in certain embodiments containing about 0-5, 0.5-5 or 1-5 wt % aromatics), and a second stream 484 that is aromatic-rich (in certain embodiments containing about 0-5, 0.5-5 or 1-5 wt % non-aromatics). All or a portion of the aromatic-rich second stream 484 can be passed to the aromatic complex 420. The first stream 482 is passed to the pre-reforming unit 450 and/or the catalytic reforming unit 400. The non-aromatics portion 482 can be split between the inlet and the outlet of the pre-reforming unit 450 in an inlet:outlet ratio ranging from 100:0 (that is, all to the pre-reforming unit 450) to 0:100 (that is, all to the catalytic reforming unit 400), and values therebetween. The split ratio can be based on the desired product slate and/or the composition of the stream, and can be controlled by an online analysis method and apparatus that determines the concentration of various components in the stream. For example the online analysis apparatus can be a gas chromatography monitoring device or a Fourier transform infrared monitoring device, programmed with chemometrics or another suitable predictive technology.

In certain embodiments 0-100 wt % of the optional light naphtha feed 432 is passed to the pre-reforming unit 450, alone or in combination with 0-100 wt % of the first stream 482, for dehydrocyclization, and to thereby produce the pre-reformed light naphtha stream 452 that contains reduced paraffinic content, and contains an increased naphthenic content and/or aromatic content, relative to the light naphtha feed 432 and the first stream 482. In certain embodiments, a separate pre-reforming unit is provided for the paraffin rich first stream 482 and for the light naphtha feed 432 (not shown).

The pre-reformed naphtha stream 452 is passed to the catalytic reforming unit 400, alone or in combination with 0-100 wt % of the first stream 482. The reformate stream 405 can be processed as full range reformate, or separated into a light reformate a heavy reformate stream, as described with respect to FIGS. 1 and 2, or otherwise utilized. In certain embodiments a separation unit such as a flash or distillation unit (not shown) is used to separate the reformate stream 405 into a light reformate a heavy reformate stream, as described with respect to FIG. 1, or otherwise utilized. For example, all or a portion of a light reformate can be passed to the gasoline pool 410, and all or a portion a heavy reformate can be passed to the aromatic complex 420. In other embodiments, the full range of the reformate stream 405 is separated by a diverter, so that all or a portion of can be passed to the gasoline pool 410, all or a portion can be passed to the aromatic complex 420, or the reformate stream 405 can be divided between the gasoline pool 410 and the aromatic complex 420. For instance, the routing selection or proportion can be based on products that are targeted in the refinery. In additional embodiments, the full range reformate stream 405 is passed to the aromatic complex 420 and aromatic-lean raffinate from the aromatic complex 420 is passed to the gasoline pool 410. Accordingly, the paraffinic portion of the naphtha or heavy naphtha stream 442 (the first stream 482) can be converted to increase the naphthenic content and contribute to the pre-reformed naphtha stream 452 as additional feed to the catalytic reforming unit 400 that is less prone to cracking into less valuable light hydrocarbons as compared to the first stream 482. In addition, when the light naphtha stream 432 is also used, that contains paraffins, iso-paraffins and naphthenes, and includes for example C5-C6 hydrocarbons, it is converted to increase the naphthenic content and contribute to the pre-reformed naphtha stream 452 as additional feed to the catalytic reforming unit 400 that is less prone to cracking into less valuable light hydrocarbons as compared to the light naphtha stream 432.

Figure 5:
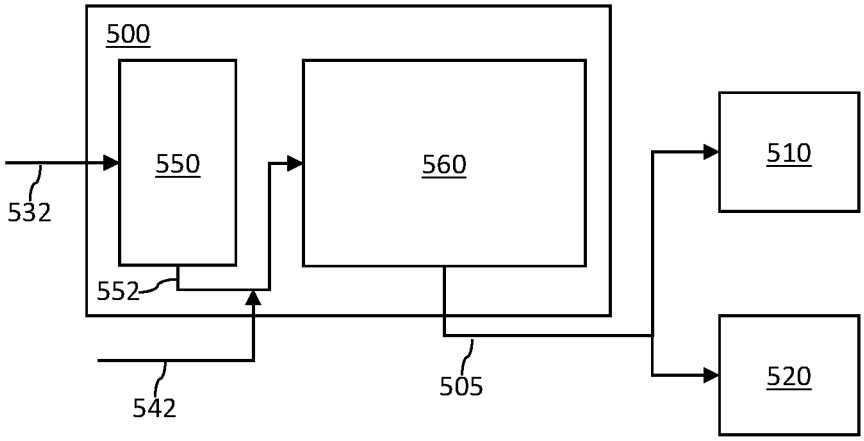
FIG. 5 is a process flow diagram of another embodiment of a process and system for treatment of naphtha to produce aromatics and gasoline.

With reference to FIG. 5, an embodiment of an integrated process and system for treatment of naphtha to produce aromatics and gasoline is schematically depicted, including a modified catalytic reforming zone 500 having a reaction zone 550 suitable for pre-reforming as described herein, which is integrated in series with one or more reactions zones (shown as a second reaction zone 560) suitable for catalytic reforming. The modified catalytic reforming zone 500 includes feeds as in the system of FIG. 3 herein, a light naphtha feed 532 and a heavy naphtha feed 542. As described herein these streams can be derived from one or more hydrotreating units, for instance as described with respect to FIGS. 1-4, or another source of light naphtha and heavy naphtha can be used, along or in combination with hydrotreated light naphtha and hydrotreated heavy naphtha, such as from another naphtha hydrotreater, wild naphtha from a hydrocracking process, or hydrotreated coker naphtha. The operating conditions and type of reactor for the pre-reforming first reaction zone 550 can be similar or the same as those described above for the pre-reforming unit 350 in the system described with respect to FIG. 3. The operating conditions, type of reactor, and reforming catalyst of the reforming reactor(s) in the second reaction zone 560 can be similar or the same as those described above with respect to the catalytic reforming zone 100 in the system described with respect to FIG. 1 that is effective for dehydrogenation and other reforming reactions. As with the arrangement described above in conjunction with FIG. 1, the system also includes a gasoline pool and an aromatic complex, shown in FIG. 5 as a gasoline pool zone 510 and an aromatic complex 520 for recovery of aromatic products (not shown).

In operation of the system depicted in FIG. 5, the light naphtha feed 532 is passed to the pre-reforming first reaction zone 550 for dehydrocyclization and to thereby produce the pre-reformed light naphtha stream 552 that contains reduced paraffinic content, and contains an increased naphthenic content and/or aromatic content, relative to the light naphtha feed 532. The pre-reformed light naphtha stream 552 is passed to the reforming reactor, or the first of a series of reforming reactors, in the second reaction zone 560, along with the heavy naphtha stream 542. The reformate stream 505 is passed to the gasoline pool 510 and/or the aromatic complex 520 as described herein Accordingly, the light naphtha stream 532 that contains paraffins, iso-paraffins and naphthenes, and includes for example C5-C6 hydrocarbons, can be converted to increase the naphthenic content and provide the pre-reformed light naphtha stream 552 as additional feed to the catalytic reforming second reaction zone 560 that is less prone to cracking into less valuable light hydrocarbons as compared to the light naphtha stream 532.

Figure 6:
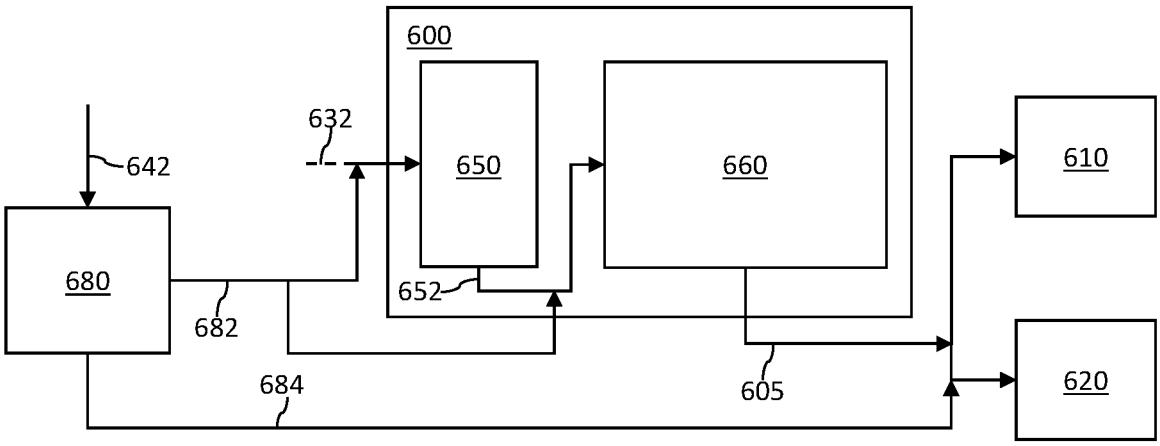
FIG. 6 is a process flow diagram of a further embodiment of a process and system for treatment of naphtha to produce aromatics and gasoline.

With reference to FIG. 6, an embodiment of an integrated process and system for treatment of naphtha to produce aromatics and gasoline is schematically depicted, including a modified catalytic reforming zone 600 having a reaction zone 650 suitable for pre-reforming as described herein, which is integrated in series with one or more reactions zones (shown as a second reaction zone 660) suitable for catalytic reforming. The modified catalytic reforming zone 600 includes feeds as in the system of FIG. 4 herein, a naphtha feed 642, or a heavy naphtha feed 642 and an optional light naphtha feed 632, and also includes an aromatic separation zone 680 that separates an aromatic-rich stream 684 and an aromatic-lean stream 682, which are treated as streams 484 and 482 in the embodiment of FIG. 4. As described herein these streams can be derived from one or more hydrotreating units, for instance as described with respect to FIGS. 1-4, or another source of light naphtha and heavy naphtha can be used, along or in combination with hydrotreated light naphtha and hydrotreated heavy naphtha, such as from another naphtha hydrotreater, wild naphtha from a hydrocracking process, or hydrotreated coker naphtha. The operating conditions and type of reactor for the pre-reforming first reaction zone 650 can be similar or the same as those described above for the pre-reforming unit 350 in the system described with respect to FIG. 3. The operating conditions, type of reactor, and reforming catalyst of the reforming reactor(s) in the second reaction zone 660 can be similar or the same as those described above with respect to the catalytic reforming zone 100 in the system described with respect to FIG. 1 that is effective for dehydrogenation and other reforming reactions. As with the arrangement described above in conjunction with FIG. 1, the system also includes a gasoline pool and an aromatic complex, shown in FIG. 6 as a gasoline pool zone 610 and an aromatic complex 620 for recovery of aromatic products (not shown).

In operation of the system depicted in FIG. 6, the heavy naphtha stream 642 is passed to the separation zone 680 to recover a first stream 682 that is aromatic-lean (in certain embodiments containing about 0-5, 0.5-5 or 1-5 wt % aromatics), and a second stream 684 that is aromatic-rich (in certain embodiments containing about 0-5, 0.5-5 or 1-5 wt % non-aromatics). All or a portion of the aromatic-rich second stream 684 can be passed to the aromatic complex 620. The first stream 682 is passed to the pre-reforming first reaction zone 650 and/or the reforming reactor, or the first of a series of reforming reactors, in the second reaction zone 660. The non-aromatics portion 682 can be split between the inlet and the outlet of the pre-reforming unit 650 in an inlet:outlet ratio ranging from 100:0 (that is, all to the pre-reforming unit 650) to 0:100 (that is, all to the second reaction zone 660), and values therebetween, for example as described with respect to FIG. 4, whereby a split ratio can be based on the desired product slate and/or the composition of the stream, and can be controlled by an online analysis method and apparatus that determines the concentration of various components in the stream. In certain embodiments 0-100 wt % of the optional light naphtha feed 632 is passed to the pre-reforming first reaction zone 650, alone or in combination with 0-100 wt % of the first stream 682, for dehydrocyclization, and to thereby produce the pre-reformed naphtha stream 652 that contains reduced paraffinic content, and contains an increased naphthenic content and/or aromatic content, relative to the light naphtha feed 632 and the first stream 682. In certain embodiments, a separate pre-reforming reaction zone is provided for the paraffin rich first stream 682 and for the light naphtha feed 632 (not shown).

The pre-reformed naphtha stream 652 is passed to the catalytic reforming second reaction zone 660, alone or in combination with 0-100 wt % of the first stream 682. The reformate stream 605, which can be separated into a light reformate a heavy reformate stream, as described with respect to FIG. 1, or otherwise utilized. For example, all or a portion of a light reformate can be passed to the gasoline pool 610, and all or a portion a heavy reformate can be passed to the aromatic complex 620. Accordingly, the paraffinic portion of the heavy naphtha stream 642 (the first stream 682) can be converted to increase the naphthenic content and contribute to the pre-reformed light naphtha stream 652 as additional feed to the catalytic reforming second reaction zone 660 that is less prone to cracking into less valuable light hydrocarbons as compared to the first stream 682. In addition, when the light naphtha stream 632 is also used, that contains paraffins, iso-paraffins and naphthenes, and includes for example C5-C6 hydrocarbons, it is converted to increase the naphthenic content and contribute to the pre-reformed light naphtha stream 652 as additional feed to the catalytic reforming second reaction zone 660 that is less prone to cracking into less valuable light hydrocarbons as compared to the light naphtha stream 632.

The separation zone 480 or 680 can be any suitable unit or arrangement of units operable to separate the naphtha feed into an aromatic-rich stream and an aromatic-lean stream. In one embodiment, the feed (naphtha or heavy naphtha 442 or 642) is conveyed to an aromatic extraction vessel in which a first, aromatic-lean, fraction is separated as a raffinate stream from a second, generally aromatic-rich, fraction as an extract stream. The raffinate stream contains at least a major proportion of the non-aromatic components of the feed, and the extract stream contains at least a major proportion of the aromatic components of the naphtha feed. A solvent feed is introduced into the aromatic extraction vessel, which typically includes one or more recycle solvent streams and an initial solvent feed and/or a make-up solvent stream.

In certain embodiments, extraction solvent is typically separated from the extract and raffinate. For instance a portion of the extraction solvent is in the extract, for instance in the range of about 70-98 or 70-85 wt % (based on the total amount of solvent to the aromatic extraction vessel). In embodiments in which solvent existing in the extract exceeds a desired or predetermined amount, solvent can be removed via a solvent-extract separation zone from the hydrocarbon product, for example, including flashing and/or stripping units, or other suitable apparatus, and solvent can be recycled to the aromatic extraction vessel, for example via a surge drum. The aromatic-rich stream is discharged, corresponding to the second stream 484 or 684 above, and can be passed to an aromatic complex, corresponding to the aromatic complex 420 or 620 above.

In addition, a portion of the extraction solvent can also exist in the raffinate, for instance in the range of about 0-30, 2-30, 2-15, 0-8 or 2-8 wt % (based on the total amount of solvent to the aromatic extraction vessel). In operations in which the solvent existing in the raffinate exceeds a desired or predetermined amount, solvent can be removed via a solvent-raffinate separation zone from the hydrocarbon product, for example, including flashing and/or stripping units, or other suitable apparatus, and solvent can be recycled to the aromatic extraction vessel, for example via a surge drum. The aromatic-lean stream is discharged from the solvent-raffinate separation zone and is passed to the pre-reforming unit 450 or reaction zone 650, and/or passed to the catalytic reforming unit 400 or reaction zone 660, as described above.

Selection of extraction solvent, operating conditions, and the mechanism of contacting the solvent and feed, permit control over the level of aromatic extraction. For instance, suitable solvents include furfural, N-methyl-2-pyrrolidone, dimethylformamide, oxidized disulfide oil, dimethylsulfoxide, phenol, nitrobenzene, sulfolanes, acetonitrile, or glycols. Suitable glycols include diethylene glycol, ethylene glycol, triethylene glycol, tetraethylene glycol, dipropylene glycol and combinations comprising at least two of the foregoing. The extraction solvent can be a pure glycol or a glycol diluted with from about 2 to 10 W % water. Suitable sulfolanes include hydrocarbon-substituted sulfolanes (e.g., 3-methyl sulfolane), hydroxy sulfolanes (e.g., 3-sulfolanol and 3-methyl-4-sulfolanol), sulfolanyl ethers (i.e., methyl-3-sulfolanyl ether), sulfolanyl esters (e.g., 3-sulfolanyl acetate) and oxidized disulfide oil. The total extraction solvent can be provided in a solvent to oil ratio (W:W) of about 20:1-1:1, 10:1-1:1, 5:1-1:1 or 4:1 to 1:1.

The aromatic separation apparatus can operate at a temperature in the range of from about 20-200, 20-100, 20-80, 40-200, 40-100 or 40-80° C. The operating pressure of the aromatic separation apparatus can be in the range of from about 1-10, 1-8 or 1-3 bars. Types of apparatus useful as the aromatic separation apparatus in certain embodiments of the system and process described herein include: stage-type extractors including but not limited to mixer-settler apparatuses and centrifugal contactors; and differential extractors (also known as "continuous contact extractors,") including but not limited to centrifugal contactors and contacting columns such as tray columns, spray columns, packed towers, rotating disc contactors and pulse columns.

The pre-reforming dehydrocyclization catalyst composition used in the pre-reforming unit or zone herein generally comprises a zeolitic component forming all or a portion of the base composition along with an inorganic oxide binder formed into particles such as sphere, and one or more active components. As compared to catalysts used in reforming, a suitable pre-reforming dehydrocyclization catalyst contains more acidic zeolite to thereby permit operation at lower temperatures compared to operation with less acidic catalyst, and accordingly minimize cracking and yield loss. The zeolitic component can include USY, MOR, MFI and/or BEA topology.

In certain embodiments, the zeolitic component of the pre-reforming dehydrocyclization catalyst composition includes an ultra-stable Y (hereafter "USY") zeolite. In certain embodiments the zeolitic component is a USY zeolite that has been framework substituted to incorporate one or more of zirconium, titanium, and hafnium into its framework (hereafter "post-framework modified USY zeolite"). The USY zeolite and/or the post-framework modified USY zeolite as the zeolitic component of the pre-reforming dehydrocyclization catalyst composition used in the process herein are made, essentially, by using the processes described in U.S. Pat. Nos. 9,221,036, 10,081,009 and 10,293,332, incorporated by reference in their entireties above.

The pre-reforming dehydrocyclization catalyst composition including the above-mentioned zeolitic component can be used alone or in effective combination with one or more additional catalyst compositions (zeolitic or otherwise) useful as dehydrocyclization catalysts that are known or become known for conversion of paraffins into naphthenes. The proportion of the pre-reforming dehydrocyclization catalyst composition including the above-mentioned zeolitic component can be about 100-1, 99-1 or 50-1 wt % of the catalyst used for pre-reforming dehydrocyclization reactions; any remainder can be one or more additional catalyst compositions (zeolitic or otherwise) useful as dehydrocyclization catalysts that are known or become known for conversion of paraffins into naphthenes. For example, one or more other dehydrocyclization catalysts can comprise a zeolitic component including MOR, MFI or BEA topology.

In certain embodiments a method for pre-reforming paraffins in the naphtha or light naphtha range comprises reacting paraffinic naphtha feed in the presence of hydrogen, under dehydrocyclization conditions, and in the presence of an effective amount of a pre-reforming dehydrocyclization catalyst composition including a USY zeolite component and/or a post-framework modified USY zeolite, alone or in combination with other catalyst compositions effective for conversion of paraffins into naphthenes.

The post-framework modified USY zeolite included in certain embodiments of the pre-reforming dehydrocyclization catalyst composition for conversion of paraffinic naphtha as described herein an ultra-stable Y-type zeolite in which silicon atoms and aluminum atoms form a zeolite framework and in which a part of the aluminum atoms is substituted with zirconium atoms and/or titanium atoms and/or hafnium atoms. The post-framework modified USY zeolite component generally contains one or more of Zr, Ti, and Hf, in an amount of from 0.1-5.0, 0.1-4.0, 0.1-3.0, 0.2-5.0, 0.2-4.0, 0.2-3.0, 0.3-5.0, 0.3-4.0 or 0.3-3.0 wt %, as calculated on their oxide basis (that is, ZrO2, TiO2 and/or HfO2) and as measured relative to the mass of the post-framework modified USY zeolite component. In certain embodiments, the amounts of individual materials supplying Zr, Ti, and Hf can be less than 0.1, 0.2 or 0.3 wt %, but when combined, the total is at least 0.1, 0.2 or 0.3 wt %. As contemplated herein, a content range (based on oxides) of zirconium atoms and/or titanium and/or hafnium atoms includes all of the contents of zirconium atoms and/or titanium and/or hafnium atoms substituted for aluminum atoms forming a zeolite framework and zirconium atoms and/or titanium and/or hafnium atoms which are not substituted for the above aluminum atoms, that is, carried on inner surfaces of the pores of the post-framework modified USY zeolite. It is appreciated by a person of skill in the art, that when the framework-substituted zeolite in the catalyst contains the zirconium atoms and the titanium atoms and/or the hafnium atoms described above, a mass ratio (in terms of oxides) of the zirconium atoms to the titanium atoms and/or the hafnium atoms is not specifically be restricted, and any ratio of zirconium or titanium or hafnium that is effective to carry out the isomerization process herein can be used.

In certain embodiments the post-framework modified USY zeolite is:

a framework-substituted zeolite in which a part of aluminum atoms forming a zeolite framework is substituted only with zirconium atoms, and is referred to as a "zirconium-substituted zeolite" or "Zr-USY";

a framework-substituted zeolite in which a part of aluminum atoms forming a zeolite framework is substituted only with titanium atoms, and is referred to as a "titanium-substituted zeolite" or "Ti-USY";

a framework-substituted zeolite in which a part of aluminum atoms forming a zeolite framework is substituted only with hafnium atoms, and is referred to as a "hafnium-substituted zeolite" or "Hf-USY";

a framework-substituted zeolite in which a part of aluminum atoms forming a zeolite framework is substituted only with zirconium atoms and titanium atoms, and is referred to as a "zirconium-titanium-substituted zeolite" or "Zr—Ti-USY");

a framework-substituted zeolite in which a part of aluminum atoms forming a zeolite framework is substituted only with hafnium atoms and titanium atoms, and is referred to as a "hafnium-titanium-substituted zeolite" or "Hf—Ti-USY");

a framework-substituted zeolite in which a part of aluminum atoms forming a zeolite framework is substituted only with zirconium atoms and hafnium atoms, and is referred to as a "zirconium-hafnium-substituted zeolite" or "Zr—Hf-USY"); and a framework-substituted zeolite in which a part of aluminum atoms forming a zeolite framework is substituted only with zirconium atoms, titanium and hafnium atoms, and is referred to as "zirconium-titanium-hafnium substituted zeolite" or "Zr—Ti-Hf-USY."

The presence of the zirconium atoms and/or titanium and/or hafnium atoms which are substituted for the aluminum atoms in the post-framework modified USY zeolite serve as constituents of the framework of the USY zeolite. Substitution can be verified by, for example, X-ray fluorescence, high frequency plasma emission spectrometry, atomic absorption spectrometry, ultraviolet-visible-near-infrared spectrophotometry (UV-Vis-NIR), Fourier transform infrared spectroscopy (FT-IR), and/or nuclear magnetic resonance spectrometry (NMR).

In some embodiments, in addition to the substituted atoms, the zirconium atoms and/or titanium and/or hafnium atoms may further be attached (carried) to the outside of, or combined with the framework of the USY-type catalyst, as described in U.S. Pat. Nos. 9,221,036, 10,081,009 and 10,293,332, incorporated by reference in their entireties above. In these embodiments, zirconium atoms and/or titanium atoms and/or hafnium atoms can be carried on or combined with inner surfaces of pores, for instance, in the form of metal oxides, that is, zirconium oxide particles and/or titanium oxide particles and/or hafnium oxide particles. The metal oxides of zirconium and/or titanium and/or hafnium are combined with inner surfaces of mesopores of the USY zeolite.

Ultra-stable Y-type zeolite is used as the zeolitic component of the pre-reforming dehydrocyclization catalyst, and/or as one of the raw materials for preparing the zeolitic component, that is, the post-framework modified USY zeolite. USY-type zeolite refers to zeolite having a crystal lattice constant (UD) generally in the range of about 2.425-2.450 or 2.430-2.450 nm, a specific surface area generally in the range of about 600-900, 600-800, 650-900 or 650-800 $m^2/g$, a molar ratio of $SiO_2$ to $Al_2O_3$, generally in the range of about 5:1-100:1, 20:1-100:1, 5:1-80:1, 20:1-80:1, 25:1-100:1 25:1-80:1; and a pore volume of about 0.3-0.74, 0.4-0.74, 0.4-0.73, 0.4-0.72, 0.4-0.71, 0.4-0.7, 0.4-0.69, 0.4-0.68, 0.4-0.67, 0.4-0.66, 0.4-0.65, 0.41-0.75, 0.42-0.75, 0.43-0.75, 0.44-0.75, 0.45-0.75, 0.46-0.75, 0.47-0.75, 0.48-0.75, 0.49-0.75, or 0.5-0.75 ml/g, and an average pore diameter of 600 angstroms or less; The crystal lattice constant can be measured by reference to ASTM method D3942, Standard Test Method for Determination of the Unit Cell Dimension of a Faujasite-Type Zeolite. The specific surface area is a value determined by the BET (Brunauer-Emmett-Teller) method using nitrogen adsorption. The ultra-stable Y-type zeolite may be prepared by any method known in the art.

Pre-reforming dehydrocyclization catalyst compositions that are formed for conversion of paraffinic naphtha as described herein as described herein comprise an effective amount of one or more inorganic oxide components, an effective amount of one or more USY zeolite components and/or post-framework modified USY zeolite components as described herein, and an effective amount of one or more active components.

The inorganic oxide component excludes the herein USY zeolite or post-framework modified USY zeolite, and typically contains a substance serving as a granulating agent or a binder. Usually, a known substance can be used as a granulating agent or binder for the pre-reforming dehydrocyclization catalyst herein. As the inorganic oxide, a porous inorganic oxide used in pre-reforming dehydrocyclization catalyst compositions in the related art can be used. Examples thereof include alumina, silica, titania, silica-alumina, alumina-titania, alumina-zirconia, alumina-boria, phosphorus-alumina, silica-alumina-boria, phosphorus-alumina-boria, phosphorus-alumina-silica, silica-alumina-titania, and silica-alumina-zirconia. In certain embodiments of the process for conversion of paraffinic naphtha as described herein, an inorganic oxide component comprising alumina, silica-alumina or a combination of alumina and silica-alumina is used in the pre-reforming dehydrocyclization catalyst compositions.

The content of the USY zeolite or the post-framework modified USY zeolite component and the inorganic oxide component of the catalytic compositions used for conversion of paraffinic naphtha as described herein as described herein are appropriately determined according to the object. The catalytic composition has USY zeolite content and/or post-framework modified USY zeolite content of about 1-50, 1-30, 1-10, 1-5, 2-50, 2-30, 2-10, 2-5, 3-50, 3-30, 3-10 or 3-5 wt %. When plural types of USY zeolite components and/or post-framework modified USY zeolite components are used in combination, they are used preferably in a proportion so that the sum of the different types of post-framework modified USY zeolite components is within the ranges herein.

In certain embodiments the pre-reforming dehydrocyclization catalyst compositions herein including the USY zeolite and/or the post-framework modified USY zeolite also has impregnated therein an active component to enhance catalytic activity for conversion of paraffinic naphtha as described herein. The active component can include or comprise a metal such as those from IUPAC Groups 9, 10 or 11 of the Periodic Table. Examples of active components included in Group 9 are rhodium and/or iridium. Examples of active components included in Group 10 are palladium and/or platinum. An example of an active component included in Group 11 is gold. In certain embodiments active components are one or more noble metals from the platinum group including ruthenium, rhodium, palladium, osmium, iridium and/or platinum.

The active component is present in an amount from 0.01-2, 0.05-2, 0.1-2, 0.01-1, 0.05-1, 0.1-1, 0.01-0.4, 0.05-0.4, or 0.1-0.4 wt % in terms of oxide(s) based on a mass of the catalyst (that is, mass of the oxide(s) of the metal(s) used as the active component relative to the mass of the pre-reforming dehydrocyclization catalyst composition including the active component, the zeolitic component and the inorganic oxide component).

Several methods may be used to add the active component(s) to the base, including but not limited to immersion (dipping), incipient wetness, and evaporative. In the most commonly used method, a calcined support is immersed in an excess of solution containing active metals or metal compounds. The solution fills the pores and is also adsorbed on the support surface, and excess solution is removed. In another method, impregnation is carried out using incipient wetness by tumbling or spraying the activated support with a volume of solution having a concentration of metal compound tailored to achieve the targeted metal level, equal to or slightly less than the pore volume of the support. The metal-loaded support is then dried and calcined. Metal oxides are formed in the process; the calcination step is also referred to as oxidation. In another method, evaporative impregnation, the support is saturated with water or with acid solution and immersed into the aqueous solution containing the metal compound. That compound subsequently diffuses into the pores of the support through the aqueous phase.

In certain embodiments a USY zeolite is framework-modified. For example a portion of the aluminum atoms within the USY zeolite framework are substituted with zirconium and/or titanium and/or hafnium atoms as disclosed in U.S. Pat. Nos. 9,221,036, 10,081,009 and 10,293,332, incorporated by reference in their entireties above.

In certain embodiments, a post-framework modified USY zeolite is produced by firing a USY zeolite having the properties described herein at about 500-700° C. A suspension is formed containing the fired USY zeolite, the suspension having a liquid/solid mass ratio of about 5-15. An inorganic acid or an organic acid is added so that a pH of the suspension is about 1.0-2.0. Subsequently a solution containing a zirconium compound and/or a titanium compound and/or a hafnium compound is mixed. The solution is neutralized with, for example, an aqueous ammonia, so that the pH of the mixed solution is about 7.

In one example of a production method for a suitable USY zeolite, a Y-type zeolite (Na—Y) is exchanged of sodium ions with ammonium ions by a conventional method, for example: dispersing Y-type zeolite in water to prepare a suspension, adding ammonium sulfate thereto, washing the solid matter with water, washing it with an ammonium sulfate aqueous solution at temperature in the range of about 40-80° C., subsequently washing it with water at temperature in the range of about 40-95° C., and drying at about 100-180° C., for example for about 30 minutes. Accordingly an ammonium-exchanged Y-type zeolite, $NH_4$-$^{50\ to\ 70}$Y, in which about 50-70 wt % of Na contained in the Y-type zeolite is substituted with $NH_4$. Subsequently, a hydrogen type Y-type zeolite (HY) is prepared by calcining the above ammonium-exchanged Y-type zeolite ($NH_4$-$^{50\ to\ 70}$Y) at about 500-800° C. for about 10 minutes to about 10 hours in, for example, a saturated vapor atmosphere. Then, an ammonium-exchanged Y-type zeolite ($NH_4$-$^{80\ to\ 97}$Y) in which about 80-97 wt % of Na contained in the initial Y-type zeolite (Na—Y) is ion-exchanged with $NH_4$ is obtained by dispersing the hydrogen type Y-type zeolite obtained above in water at a temperature of about 40-95° C. to prepare a suspension, adding ammonium sulfate thereto, then stirring the suspension at a temperature of about 40-95° C. for about 10 minutes to about 3 hours, further washing the solid matter with water a temperature of about 40-95° C., next washing it with an ammonium sulfate aqueous solution a temperature of about 40-95° C., subsequently washing it with water a temperature of about 40-80° C. and then drying it at about 100-180° C. for about 30 minutes to about 30 hours. In certain embodiments the final ammonium ion exchange rate is 90% or greater. The ammonium-exchanged Y zeolite ($NH_4$-$^{80\ to\ 97}$Y) thus obtained is calcined at about 500-700° C. for about 10 minutes to about 10 hours in, for example, a saturated vapor atmosphere. Accordingly a USY zeolite is prepared having the properties described herein.

In the method for producing USY zeolite used in the pre-reforming dehydrocyclization catalyst composition herein, extraskeletal aluminum (aluminum atoms which do not form part of the zeolite framework) can be removed from the ultra-stable Y-type zeolite raw material in order to obtain the USY zeolite. Extraskeletal aluminum can be removed by, for example, a method of dispersing the ultra-stable Y-type zeolite described above in water at a temperature of about 40-95° C. to prepare a suspension, adding sulfuric acid to the thus-formed suspension and stirring it for about 10 minutes to about 3 hours while maintaining the temperature at about 40-95° C. to thereby dissolve the extraskeletal aluminum. After dissolving the extraskeletal aluminum, the suspension is filtrated, and a residue on the filter is washed with purified water at about 40-95° C. and dried at a temperature of about 100-180° C. for about 3-30 hours, whereby an ultra-stable Y-type zeolite from which the extraskeletal aluminum is removed can be obtained.

In the method for producing the post-framework modified USY zeolite herein, the USY zeolite which is the raw material is calcined at a temperature of about 500-700, 500-650, 550-700 or 550-650° C. The time of calcining is typically not critical so long as the targeted post-framework modified USY zeolite is obtained, for instance, in a range of about 30 minutes to about 10 hours. In certain embodiments calcining occurs in air. If the calcining temperature is lower than about 500° C., the framework substitution amount of zirconium atoms and/or titanium atoms and/or hafnium atoms tends to be reduced; at calcining temperatures that exceed about 700° C., the specific surface area of the ultra-stable Y-type zeolite can be reduced, and a framework substitution amount of zirconium atoms and/or titanium atoms and/or hafnium atoms is thus reduced.

The calcined ultra-stable Y-type zeolite is suspended in water having a temperature of about 20-30° C. to form a suspension. With respect to the concentration of the suspension of the ultra-stable Y-type zeolite, the liquid/solid mass ratio is generally in the range of about 5:1-15:1, 5:1-12:1, 8:1-15:1 or 8:1-12:1.

Next, an inorganic acid or an organic acid is added thereto so that a pH of the suspension described above is controlled to a range of about <2.0, and subsequently a solution containing a zirconium compound and/or titanium compound and/or a hafnium compound is added and admixed. The thus mixed solution is neutralized (for example, to a pH of about 7.0-7.5), and dried (for example, at a temperature of about 80-180° C.), whereby the post-framework modified USY zeolite described above can be obtained.

The inorganic acid use can generally be sulfuric acid, nitric acid, hydrochloric acid and the like. In certain embodiments the selected inorganic acid is sulfuric acid or hydrochloric acid. Further, carboxylic acids can suitably be used as the organic acid described above. The quantity of inorganic acid or organic acid is not critical, so long as the pH of the suspension is controlled in the range of about <2.0. For example, a 0.5- to 4.0-fold molar amount, and in certain embodiments a 0.7- to 3.5-fold molar, amount based on an amount of $Al_2O_3$ in the ultra-stable Y-type zeolite, can be used, although these ranges are not critical.

Suitable zirconium compounds described above include one or more of zirconium sulfate, zirconium nitrate, zirconium chloride and the like. In certain embodiments zirconium sulfate and/or zirconium nitrate are selected. The quantity of the zirconium compound added is generally about 0.1-5.0, 0.1-4.0, 0.1-3.0, 0.2-5.0, 0.2-4.0, 0.2-3.0, 0.3-5.0, 0.3-4.0 or 0.3-3.0 wt %, as calculated on their oxide basis (that is, zirconium oxide) and as measured relative to the mass of the post-framework modified USY zeolite component. Addition of the zirconium compound in an amount of less than about 0.1 wt % fails to improve solid acid characteristics of the zeolite. The addition of the zirconium compound in an amount exceeding 5 wt % tends to cause clogging of pores of the zeolite. An aqueous solution of a zirconium compound prepared by dissolving the zirconium compound in water can be used as the zirconium compound.

Suitable titanium compounds include one or more of titanium sulfate, titanium acetate, titanium chloride, titanium nitrate, and titanium lactate. In certain embodiments titanium sulfate and/or titanium acetate are selected. The quantity of the titanium compound added is generally about 0.1-5.0, 0.1-4.0, 0.1-3.0, 0.2-5.0, 0.2-4.0, 0.2-3.0, 0.3-5.0, 0.3-4.0 or 0.3-3.0 wt %, as calculated on their oxide basis (that is, titanium oxide) and as measured relative to the mass of the post-framework modified USY zeolite component. Addition of the titanium compound in an amount of less than about 0.1 wt % fails to improve solid acid characteristics of the zeolite. The addition of the titanium compound in an amount exceeding 5 wt % tends to cause clogging of pores of the zeolite. An aqueous solution of a titanium compound prepared by dissolving the titanium compound in water can be used as the titanium compound.

Suitable hafnium compounds described above include one or more of hafnium chloride, hafnium nitrate, hafnium fluoride, hafnium bromide, hafnium oxalate and the like. In certain embodiments hafnium chloride and/or hafnium nitrate are selected. The quantity of the hafnium compound added is generally about 0.1-5.0, 0.1-4.0, 0.1-3.0, 0.2-5.0, 0.2-4.0, 0.2-3.0, 0.3-5.0, 0.3-4.0 or 0.3-3.0 wt %, as calculated on their oxide basis (that is, hafnium oxide) and as measured relative to the mass of the post-framework modified USY zeolite component. Addition of the hafnium compound in an amount of less than about 0.1 wt % fails to improve solid acid characteristics of the zeolite. The addition of the hafnium compound in an amount exceeding 5 wt % tends to cause clogging of pores of the zeolite. An aqueous solution of a hafnium compound prepared by dissolving the hafnium compound in water can be used as the hafnium compound.

A pH of the above suspension is controlled to about <2.0 to preventing precipitate from being generated during mixing of the aqueous solution of the zirconium compound and/or the hafnium compound and/or the titanium compound with a suspension of the ultra-stable Y-type zeolite described above.

Mixing of the aqueous solution of the zirconium compound and/or the hafnium compound and/or the titanium compound with a suspension of the ultra-stable Y-type zeolite is, in certain embodiments, is conducted by gradually adding said aqueous solution to the suspension. After completion of addition of the aqueous solution described above to the suspension, the solution can be mixed by stirring at, for example, room temperature (about 25-35° C.) for about 3-5 hours. Further, after completion of the above-described mixing, the admixed solution is neutralized by adding an alkali compound such as aqueous ammonia and/or the like, so that a pH thereof is controlled to about 7.0-7.5, whereby the post-framework modified USY zeolite described herein is be obtained.

In this regard: when only the zirconium compound (or an aqueous solution thereof) is used as the compound (or an aqueous solution thereof) added to the suspension described above, the post-framework modified USY zeolite (Zr-USY) in which zirconium atoms is substituted for a part of aluminum atoms forming the framework of the ultra-stable Y-type zeolite is formed; when only the titanium compound (or an aqueous solution thereof) is used, the post-framework modified USY zeolite (Ti-USY) in which titanium atoms is substituted for a part of aluminum atoms forming the framework of the ultra-stable Y-type zeolite is formed; when only the hafnium compound (or an aqueous solution thereof) is used, the post-framework modified USY zeolite (Hf-USY) in which hafnium atoms is substituted for a part of aluminum atoms forming the framework of the ultra-stable Y-type zeolite is formed; when the zirconium compound and the titanium compound (or aqueous solutions thereof) are used, the post-framework modified USY zeolite in the catalyst (Zr—Ti-USY) in which zirconium atoms and titanium atoms are substituted for a part of aluminum atoms forming the framework of the ultra-stable Y-type zeolite is formed; when the zirconium compound and the hafnium compound (or aqueous solutions thereof) are used, the post-framework modified USY zeolite in the catalyst (Zr—Hf-USY) in which zirconium atoms and hafnium atoms are substituted for a part of aluminum atoms forming the framework of the ultra-stable Y-type zeolite is formed; when the hafnium compound and the titanium compound (or aqueous solutions thereof) are used, the post-framework modified USY zeolite in the catalyst (Hf—Ti-USY) in which hafnium atoms and titanium atoms are substituted for a part of aluminum atoms forming the framework of the ultra-stable Y-type zeolite is formed; and when the zirconium compound, the titanium compound and the hafnium compound (or aqueous solutions thereof) are used, the post-framework modified USY zeolite in the catalyst (Zr—Ti-Hf-USY) in which zirconium atoms, titanium atoms and hafnium atoms are substituted for a part of aluminum atoms forming the framework of the ultra-stable Y-type zeolite is formed.

The resulting framework-substituted zeolite can be filtered, if desired, washed with water, and dried at about 80-180° C.; the mixture can be quasi-equilibrated with steam, for instance, at a temperature of from about 600-800° C. for about 10-20 hours.

EXAMPLES

Example 1—USY

First, 50.0 kg of a NaY zeolite (hereinafter, also referred to as "NaY") having a $SiO_2/Al_2O_3$ molar ratio of 5.2, a unit cell dimension (UD) of 2.466 nm, a specific surface area (SA) of 720 $m^2/g$, and a $Na_2O$ content of 13.0% by mass was suspended in 500 liter (hereinafter, also expressed as "L") of water having a temperature of 60° C. Then, 14.0 kg of ammonium sulfate was added thereto. The resulting suspension was stirred at 70° C. for 1 hour and filtered. The resulting solid was washed with water. Then the solid was washed with an ammonium sulfate solution of 14.0 kg of ammonium sulfate dissolved in 500 L of water having a temperature of 60° C., washed with 500 L of water having a temperature of 60° C., dried at 130° C. for 20 hours, thereby affording about 45 kg of a Y zeolite ($NH_4$ $^{65}Y$) in which 65% of sodium (Na) contained in NaY was ion-exchanged with ammonium ion ($NH_{41}$). The content of $Na_2O$ in $NH_4$ $^{65}Y$ was 4.5% by mass.

$NH_4$ $^{65}Y$ 40 kg was fired in a saturated water vapor atmosphere at 670° C. for 1 hour to form a hydrogen-Y zeolite (HY). HY was suspended in 400 L of water having a temperature of 60° C. Then 49.0 kg of ammonium sulfate was added thereto. The resulting mixture was stirred at 90° C. for 1 hour and washed with 200 L of water having a temperature of 60° C. The mixture was then dried at 130° C. for 20 hours, thereby affording about 37 kg of a Y zeolite ($NH_4$ $^{95}Y$) in which 95% of Na contained in the initial NaY was ion-exchanged with $NH_4$. $NH_4$ $^{95}Y$ 33.03 kg was fired in a saturated water vapor atmosphere at 650° C., for 1 hour, thereby affording about 15 kg of a ultra stable Y zeolite (hereinafter, also referred to as "USY(a)") having a $SiO_2/Al_2O_3$ molar ratio of 5.2 and a $Na_2O$ content of 0.60% by mass.

Next, 26.0 kg of this USY(a) was suspended in 260 L of water having a temperature of 60° C. After 61.0 kg of 25% sulfuric acid by mass was gradually added to the suspension, the suspension was stirred at 70° C. for 1 hour. The suspension was filtered. The resulting solid was washed with 260 liter of deionized water having a temperature of 60° C. and dried 130° C. for 20 hours, thereby affording a ultra stable Y-type zeolite (hereinafter, also referred to as "USY(b)").

USY (b) was fired at 600° C. for 1 hour, thereby affording about 17 kg of ultra stable Y-type zeolite (hereinafter, also referred to as "USY").

Example 2—Ti—Zr-USY 1 kg of USY obtained in Example 1 was suspended in 10 L of water at 25° C., and the pH of the solution was adjusted to 1.6 by sulfuric acid of 25% by mass. Zirconium sulfate of 18% by mass (86 g) and titanyl sulfate of 33% by mass (60 g) were added and mixed, and the suspension was stirred at room temperature for 3 hours. Then, the pH was adjusted to 7.2 by adding 15% by mass aqueous ammonia, and the suspension was stirred at room temperature for 1 hour and then filtered. A matter obtained was washed with 10 L of water and dried at 130° C. for 20 hours to obtain about 1 kg of a zirconium/titanium-substituted type zeolite (hereinafter referred to as "Ti—Zr-USY").

Example 3—Pt/Ti—Zr-USY Zeolite

A catalyst support was prepared by combining 95 wt % of an alumina binder as a support, and 5 wt % of a Ti—Zr-USY prepared in accordance with Example 2, supra. This support was then impregnated with Pt, by mixing 600 g of the support with a solution of tetra-amine Pt containing 1.9 wt % Pt. (This solution was prepared by dissolving 63 g of tetra-amine platinum in water). This served to impregnate the catalyst support with Pt. The product was then air dried at 120° C. for one hour, and calcined at 400° C. for one hour. Analysis showed that 0.2 wt % Pt had been impregnated in the support.

Example 4—Conversion of Paraffinic Naphtha

A paraffinic naphtha sample containing C5-C6 hydrocarbons, the properties and composition of which are shown in Table 1, was used as a feedstock to demonstrate dehydrogenation and dehydrocyclization reactions. The experiments were conducted in a pilot plant with a fixed-bed reactor. The pilot plant was loaded with 20 cubic centimeters of a catalyst containing Ti—Zr modified USY zeolite and platinum as active phase metal as in Example 3. The pilot plant was operated at 3 bars, a LHSV of 4 $h^{-1}$, a hydrogen to hydrocarbon molar ratio of 3.35 (625 standard liters of hydrogen per liter of hydrocarbon feed (SLt/Lt)), and at temperatures of 475, 525 and 575° C., and again at 475° C. for longer time of on stream operation.

As is apparent in Table 1, the naphthenic content increased with increasing temperatures, and maintained high production at longer time on stream as a result of adjusted activity of the used catalyst. A measure of the quality of reformer feed is the weight % of naphthenes, and 2 times the aromatics; clearly the treated product showed improvements, and over 100% improvement at one condition (from 22.2% to 44.8%).

The results in Table 1 also show that Parrafins (P) and iso-paraffins (iP) decrease with increasing temperature and produce more naphthenes (N). Naphthenic content continues to be produced at lower temperature and longer time on stream as the catalyst activity is adjusted as a result of gradual deactivation. This is evident from the N+2A measure that continued to increase and subsequently declined and leveled-off at longer times.

While not shown, the skilled artisan will understand that additional equipment, including exchangers, furnaces, pumps, columns, and compressors to feed the reactors, to maintain proper operating conditions, and to separate reaction products, are all part of the systems described.

The methods and systems of the present invention have been described above and in the attached drawings; however, modifications will be apparent to those of ordinary skill in the art and the scope of protection for the invention is to be defined by the claims that follow.

TABLE 1

| Property | Feed | 475° C. | 525° C. | 575° C. | 475° C. | 475° C. |
|---|---|---|---|---|---|---|
| Time on Stream, hr | 0 | 22 | 50 | 99 | 143 | 148 |
| n-Paraffins, W % | 28.5 | 24.7 | 21.5 | 24.3 | 24.9 | 24.8 |
| i-Paraffins, W % | 48.1 | 44.8 | 36.8 | 39.7 | 42.7 | 42.8 |
| total Paraffins, W % | 76.6 | 69.5 | 58.3 | 64.0 | 67.6 | 67.6 |
| Naphthenes, W % | 15.5 | 16.0 | 27.5 | 23.2 | 29.3 | 29.3 |
| Aromatics, W % | 3.4 | 11.4 | 8.6 | 5.6 | 2.5 | 2.4 |
| Olefins, W % | 4.6 | 3.1 | 5.6 | 7.1 | 0.6 | 0.6 |
| RON | 74.6 | 76.0 | 74.7 | 75.1 | 72.9 | 72.9 |
| RVP, psi | 9.3 | 8.0 | 6.3 | 8.4 | 7.7 | 7.7 |
| N + 2A, W % | 22.2 | 38.8 | 44.8 | 34.5 | 34.2 | 34.2 |

The invention claimed is:

1. An integrated process for catalytic reforming of hydrotreated naphtha having less than 0.5 ppmw sulfur and nitrogen, the process comprising:

separating a hydrotreated naphtha feedstream into a light naphtha stream and a heavy naphtha stream, wherein the light naphtha stream consists of at least 90 weight % C5-C6 hydrocarbons and is characterized by a first N+2A value where N+2A is a sum of naphthenic compound compositional content and two times aromatic compositional content, and wherein the heavy naphtha stream consists of at least 90 weight % C7-C11 or C7-C12 hydrocarbons;

pre-reforming all or a portion of the light naphtha stream in the presence of hydrogen and an effective pre-reforming dehydrocyclization catalyst to produce a pre-reformed stream having decreased paraffinic content, and an increased naphthenic content and/or aromatic content, relative to the light naphtha stream, and wherein the pre-reformed stream has a second N+2A value that is greater than the first N+2A value;

catalytically reforming the heavy naphtha stream and the pre-reformed stream to produce a reformate stream.

2. The process as in claim 1, wherein pre-reforming occurs in a unit that is separate from a unit in which catalytic reforming occurs.

3. The process as in claim 1, wherein pre-reforming and catalytic reforming occur in a common catalytic reforming zone including a pre-reforming reactor in which pre-reforming occurs that us upstream of a catalytic reforming reactor in which catalytic reforming occurs.

4. The process as in claim 1, further comprising recovering at least a portion of the reformate stream as gasoline blending components, and/or passing at least a portion of the reformate stream to an aromatic complex for recovery of aromatic products.

5. The process as in claim 1, wherein a temperature cut point between the light naphtha stream and the heavy naphtha stream is about 80-88° C.

6. The process as in claim 1, wherein a temperature cut point between the light naphtha stream and the heavy naphtha stream is about 80° C.

7. An integrated process for catalytic reforming of hydrotreated naphtha having less than 0.5 ppmw sulfur and nitrogen, the process comprising:

separating a hydrotreated naphtha feedstream into an aromatic-rich stream and an aromatic-lean stream by contacting the feedstream with an extraction solvent and separating into an extract from which the aromatic-rich stream is obtained and a raffinate from which the aromatic-lean stream is obtained, wherein the aromatic-lean stream includes no more than 5 weight percent aromatic compounds and is characterized by a first N+2A value where N+2A is a sum of naphthenic compound compositional content and two times aromatic compositional content;

pre-reforming all or a portion of the aromatic-lean stream in the presence of hydrogen and an effective pre-reforming dehydrocyclization catalyst to produce a pre-reformed stream having decreased paraffinic content, and an increased naphthenic content and/or aromatic content, relative to the aromatic-lean stream, and wherein the pre-reformed stream has a second N+2A value that is greater than the first N+2A value;

catalytically reforming the pre-reformed stream to produce a reformate stream; and separating all or a portion of the aromatic-rich stream in an aromatic complex for recovery of aromatic products.

8. The process as in claim 7, further comprising separating a hydrotreated naphtha feedstream into a light naphtha stream and a heavy naphtha stream, wherein the light naphtha stream consists of at least 90 weight % C5-C6 hydrocarbons and wherein the heavy naphtha feedstream consists of at least 90 weight % C7-C11 or C7-C12 hydrocarbons, wherein the feedstream is all or a portion of the heavy naphtha stream, and wherein the light naphtha stream is subjected to pre-reforming together with or separate from all or a portion of the aromatic-lean stream.

9. The process as in claim 8, wherein a temperature cut point between the light naphtha stream and the heavy naphtha stream is about 80-88° C.

10. The process as in claim 8, wherein a temperature cut point between the light naphtha stream and the heavy naphtha stream is about 80° C.

11. The process as in claim 8, wherein the light naphtha stream is subjected to pre-reforming together with all or a portion of the aromatic-lean stream.

12. The process as in claim 8, wherein at least a portion of the reformate stream is passed to the aromatic complex together with all or a portion of the aromatic-rich stream for recovery of aromatic products.

13. The process as in claim 7, wherein at least a portion of the reformate stream is passed to the aromatic complex together with all or a portion of the aromatic-rich stream for recovery of aromatic products.

14. The process as in claim 7, wherein pre-reforming occurs at: a reaction temperature range of about 400-600° C.; a pressure of about 1-20 bars; an LHSV, on a fresh feed basis relative to the dehydrocyclization catalysts, of about 1-5 $h^{-1}$; and a hydrogen/hydrocarbon mole ratio of about 1-10.

15. The process as in claim 14, wherein the pre-reforming dehydrocyclization catalyst comprises an active component carried on a support containing an inorganic oxide and a zeolitic component comprising an ultra-stable Y-type (USY) zeolite, and wherein the active component comprises a platinum group metal selected from the group consisting of ruthenium, rhodium, palladium, osmium, iridium and platinum.

16. The process as in claim 14, wherein the pre-reforming dehydrocyclization catalyst comprises an active component carried on a support containing an inorganic oxide and zeolitic component comprising an ultra-stable Y-type (USY) zeolite in which a portion of aluminum atoms of the framework of said USY zeolite thereof is substituted with zirconium atoms and/or titanium and/or hafnium atoms forming a post-framework modified USY zeolite, wherein said post-framework modified USY zeolite contains from 0.1 to 5 mass % zirconium atoms and/or titanium and/or hafnium atoms as calculated as the oxide basis, and wherein the active component comprises a platinum group metal selected from the group consisting of ruthenium, rhodium, palladium, osmium, iridium and platinum.

17. The process as in claim 1, wherein pre-reforming occurs at: a reaction temperature range of about 400-600° C.; a pressure of about 1-20 bars; an LHSV, on a fresh feed basis relative to the dehydrocyclization catalysts, of about 1-5 $h^{-1}$; and a hydrogen/hydrocarbon mole ratio of about 1-10.

18. The process as in claim 17, wherein the pre-reforming dehydrocyclization catalyst comprises an active component carried on a support containing an inorganic oxide and a zeolitic component comprising an ultra-stable Y-type (USY) zeolite, and wherein the active component comprises a platinum group metal selected from the group consisting of ruthenium, rhodium, palladium, osmium, iridium and platinum.

19. The process as in claim 17, wherein the pre-reforming dehydrocyclization catalyst comprises an active component carried on a support containing an inorganic oxide and zeolitic component comprising an ultra-stable Y-type (USY) zeolite in which a portion of aluminum atoms of the framework of said USY zeolite thereof is substituted with zirconium atoms and/or titanium and/or hafnium atoms forming a post-framework modified USY zeolite, wherein said post-framework modified USY zeolite contains from 0.1 to 5 mass % zirconium atoms and/or titanium and/or hafnium atoms as calculated as the oxide basis, and wherein the active component comprises a platinum group metal selected from the group consisting of ruthenium, rhodium, palladium, osmium, iridium and platinum.

* * * * *